US011752395B2

(12) United States Patent
Wakibayashi et al.

(10) Patent No.: US 11,752,395 B2
(45) Date of Patent: Sep. 12, 2023

(54) ASSEMBLY BALL

(71) Applicant: MOLTEN CORPORATION, Hiroshima (JP)

(72) Inventors: Kazuyuki Wakibayashi, Hiroshima (JP); Jun Uchida, Hiroshima (JP); Shunpei Katsuta, Hiroshima (JP)

(73) Assignee: MOLTEN CORPORATION, Hiroshima (JP)

( * ) Notice: Subject to any disclaimer, the term of this patent is extended or adjusted under 35 U.S.C. 154(b) by 18 days.

(21) Appl. No.: 17/609,947

(22) PCT Filed: Mar. 10, 2020

(86) PCT No.: PCT/JP2020/010250
§ 371 (c)(1),
(2) Date: Nov. 9, 2021

(87) PCT Pub. No.: WO2020/230428
PCT Pub. Date: Nov. 19, 2020

(65) Prior Publication Data

US 2022/0203176 A1 Jun. 30, 2022

(30) Foreign Application Priority Data

May 10, 2019 (JP) ..... 2019-089957
Jan. 24, 2020 (JP) ..... 2020-010397

(51) Int. Cl.
*A63B 39/06* (2006.01)

(52) U.S. Cl.
CPC ..... *A63B 39/06* (2013.01)

(58) Field of Classification Search
CPC .... A63B 39/06; A63B 2039/003; A63B 39/00
(Continued)

(56) References Cited

U.S. PATENT DOCUMENTS 442,618 A * 12/1890 Greene ..... 273/398
2,791,868 A * 5/1957 Reidar ..... A63H 33/062 446/107

(Continued)

FOREIGN PATENT DOCUMENTS

CN 201132045 Y * 10/2008
JP S548142 B2 4/1979

(Continued)

OTHER PUBLICATIONS

Japan Patent Office; International Search Report and Written Opinion for Application No. PCT/JP2020/010250 dated May 26, 2020.

(Continued)

*Primary Examiner* — Steven B Wong
(74) *Attorney, Agent, or Firm* — PARSONS BEHLE & LATIMER

(57) ABSTRACT

According to one embodiment, an assembly ball includes a plurality of strips having a circumferential length. The strips are assembled convexly outward as viewed in the radial direction so as to substantially form a sphere as a whole. The strips each overlap other strips at their respective strip overlapping portions where the strips intersect with one another. The strip overlapping portions are joined by a strip joining member.

6 Claims, 11 Drawing Sheets

(58) Field of Classification Search
USPC ..... 473/612
See application file for complete search history.

(56) References Cited

U.S. PATENT DOCUMENTS

| | | | | | |
|---|---|---|---|---|---|
| 3,046,016 | A * | 7/1962 | Laws | A63F 3/00094 | 473/612 |
| 3,977,683 | A * | 8/1976 | Tomura | A63F 9/088 | 473/612 |
| 4,542,902 | A * | 9/1985 | Massino | A63B 45/00 | 273/DIG. 20 |
| 4,813,674 | A * | 3/1989 | Lorhpipat | A63B 39/00 | 446/107 |
| D308,994 | S * | 7/1990 | Norman | D21/713 | |
| 5,224,959 | A * | 7/1993 | Kasper | A63B 21/00069 | 446/85 |
| 5,566,937 | A * | 10/1996 | Lorhpipat | A63B 39/00 | 446/107 |
| D379,105 | S * | 5/1997 | Wilk | D21/714 | |
| D631,213 | S * | 1/2011 | Morton | D30/160 | |
| 9,788,530 | B2 * | 10/2017 | Baikie | A01K 15/026 | |
| D822,334 | S * | 7/2018 | Baikie | D1/199 | |
| 10,518,138 | B2 * | 12/2019 | Lyon | A63B 41/08 | |
| 2004/0134136 | A1 * | 7/2004 | Shearing | B64B 1/06 | 473/612 |
| 2007/0254754 | A1 * | 11/2007 | Lorhpipat | A63B 39/00 | 473/612 |
| 2009/0170645 | A1 * | 7/2009 | Silvergate | A63B 39/00 | 473/612 |
| 2010/0056310 | A1 * | 3/2010 | Silverglate | A63B 43/002 | 473/612 |
| 2013/0045660 | A1 | 2/2013 | Lyrsell | | |
| 2014/0248980 | A1 * | 9/2014 | Lorhpipat | A63B 39/00 | 473/612 |
| 2016/0107045 | A1 * | 4/2016 | Lorhpipat | A63B 39/06 | 473/612 |
| 2021/0128986 | A1 * | 5/2021 | Lorhpipat | A63B 45/00 | |
| 2021/0370143 | A1 * | 12/2021 | Molinari | A63B 41/08 | |

FOREIGN PATENT DOCUMENTS

| | | |
|---|---|---|
| JP | 2001236008 A | 8/2001 |
| JP | 3086207 | 6/2002 |
| KR | 20180079120 A | 7/2018 |

OTHER PUBLICATIONS

The State Intellectual Property Office of People's Republic of China; First Office Action for Application No. 202080034753.8 dated Apr. 7, 2022.

* cited by examiner

ASSEMBLY BALL

CROSS-REFERENCE TO RELATED APPLICATIONS

This application is the National Stage of International Application No. PCT/JP2020/010250 filed Mar. 10, 2020 which claims priority under 35 U.S.C. § 119(b) to Japanese Patent Application No. 2019-089957 filed May 10, 2019 and to Japanese Patent Application No. 2020-010397 filed Jan. 24, 2020, the entire contents of each of which are hereby incorporated by reference in their entirety.

TECHNICAL FIELD

The present invention relates to an assembly ball.

Background

In general, balls used in sports, games or recreation are inflated with air. Meanwhile, there may be cases where an assembly ball that is not inflated with air is used. For example, the game of sepak takraw is played with a basket-like woven ball which is made from rattan; plastic balls are now replacing the traditional rattan ball. In addition, various types of assembly balls have been proposed for recreational use. Such assembly balls are often toys that children can enjoy assembling.

As an example of the assembly balls, a sepak takraw ball may have uniform shape, weight, and outer diameter. In order to make the sepak takraw ball, six synthetic resin strips with uniform shape and weight each having grooves for meshing on the sides are prepared, and they are combined (woven) based on a certain rule. In another example, an assembly ball can be taken apart and reassembled, which is not only entertaining as a puzzle but also useful for brain and intellectual development. The example assembly ball is composed of pentagonal pieces each having insertion pins and hexagonal pieces each having insertion holes on the corresponding sides. The ball pieces are assembled into a soccer ball shape by inserting the pins in the holes to fix the pieces to one another.

SUMMARY

However, the conventional assembly balls have problems. The ball of Patent Document 1 requires to weave constituent elements, i.e., long synthetic resin strips, so that the assembly process is complicated and the ball cannot be easily assembled. As to the ball of Patent Document 2, the rebound property of the ball is insufficient even for recreational use, resulting in a lack of playability as a ball.

The present disclosure is made in view of the above problems. An object of the present disclosure is to provide an assembly ball having an appropriate rebound property, which is made of simple constituent elements without a complicated assembly process.

Means for Solving the Problems

To achieve the object mentioned above:

(1) According to the first aspect, an assembly ball includes a plurality of strips having a circumferential length. The strips are assembled convexly outward as viewed in the radial direction so as to substantially form a sphere as a whole. The strips each overlap other strips at their respective strip overlapping portions where the strips intersect with one another. The strip overlapping portions are joined by a strip joining member.

In the assembly ball of the first aspect, each of the strips may be divided in the circumferential direction into short strips. Each of the short strips may include a first end portion, a second end portion, and an intermediate portion between them. Among three short strips, the first end portion of a first short strip, the second end portion of a second short strip, and the center of the intermediate portion of a third short strip may be overlapped as the strip overlapping portions.

The assembly ball may further comprises an embedded plate that is assembled to the strips. The embedded plate may include a lid portion and an attachment portion projecting from the outer periphery of the lid portion. The attachment portion may be overlapped with an end side of the intermediate portion of a corresponding one of the short strips. The embedded plate may be joined to the strips by an embedded plate joining member such that the lid portion fills at least one space formed by the strips.

Each of the short strips may include, as the strip joining member, a protrusion that protrudes from the intermediate portion toward the inner side of the sphere, and a strip hole formed in the first end portion and the second end portion, in which the protrusion is fitted.

The protrusion may include three protrusions in the intermediate portion. The first end portion and the second end portion may be each provided with the strip hole.

The embedded plate may include an embedded plate hole in the attachment portion as the embedded plate joining member.

The embedded plate may be joined to the strips such that a separation portion is provided between the peripheral edge of the lid portion of the embedded plate and the strips.

(2) According to the second aspect, an assembly ball includes a plurality of strips having a circumferential length and an embedded plate that is assembled to the strips. The strips are assembled convexly outward as viewed in the radial direction so as to substantially form a sphere as a whole. The strips each overlap other strips at their respective strip overlapping portions where the strips intersect with one another. The embedded plate includes a lid portion and an attachment portion projecting from the outer periphery of the lid portion. The attachment portion is overlapped with the strips. The embedded plate is joined to the strips by an embedded plate joining member such that the lid portion fills at least one space formed by the strips.

In the assembly ball of the second aspect, each of the strips may be divided in the circumferential direction into short strips. Each of the short strips may include a first end portion, a second end portion, and an intermediate portion between them. Among three short strips, the first end portion of a first short strip, the second end portion of a second short strip, and the center of the intermediate portion of a third short strip may be overlapped as the strip overlapping portions. The attachment portion of the embedded plate may be overlapped with an end side of the intermediate portion of a corresponding one of the short strips.

Each of the short strips may include a protrusion that protrudes from the intermediate portion toward the inner side of the sphere. The embedded plate may include an embedded plate hole in the attachment portion as the embedded plate joining member.

The embedded plate may be joined to the strips such that a separation portion is provided between the peripheral edge of the lid portion of the embedded plate and the strips.

Effects

According to one aspect, it is possible to provide an assembly ball having an appropriate rebound property, which is made of simple constituent elements without a complicated assembly process.

BRIEF DESCRIPTION OF THE DRAWINGS

FIG. 6(*a*) illustrates a bifurcated protrusion, and FIG. 6(*b*) illustrates a trifurcated protrusion.

FIG. 7(*a*) illustrates an example in which a lid portion and an attachment portion are integrally formed, and FIG. 7(*b*) illustrates an example in which a lid portion and an attachment portion are formed separately.

DETAILED DESCRIPTION

Figure 1:
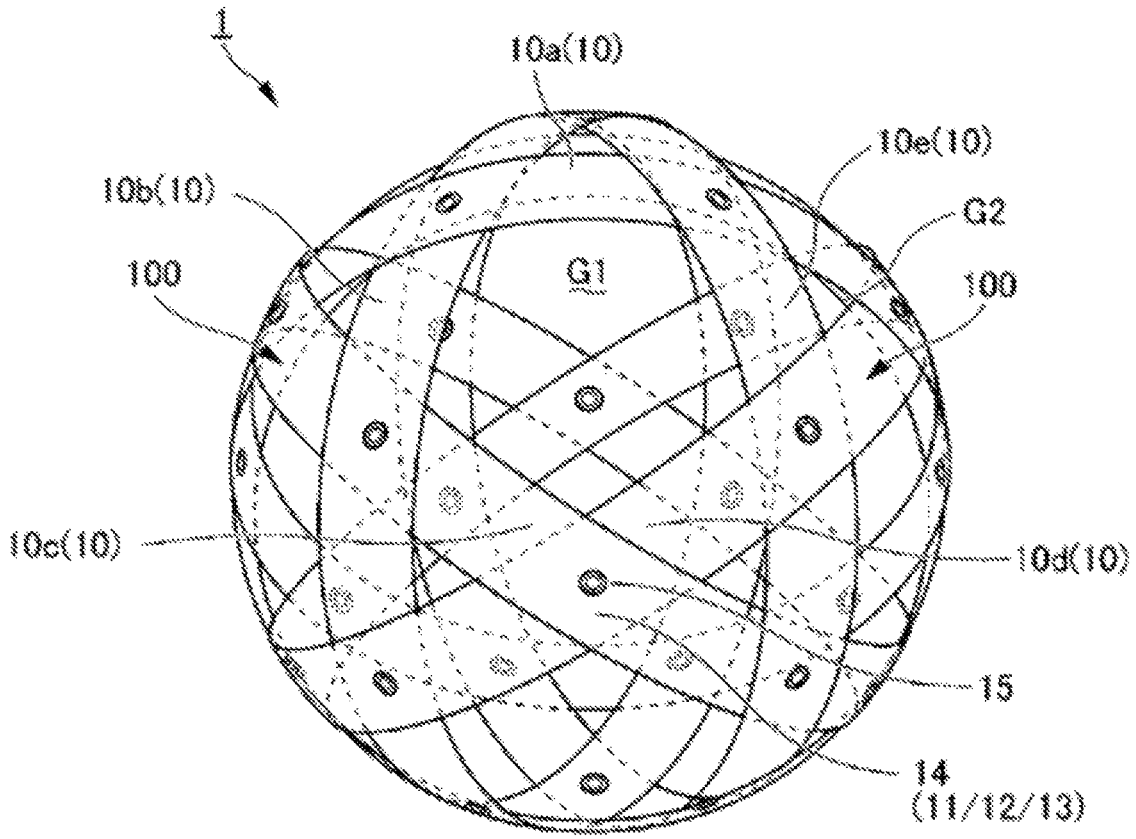
FIG. 1 is a front view of an assembly ball, which is made only of strips, according to the first embodiment.

In the following, modes (hereinafter, "embodiments") will be described in detail with reference to the accompanying drawings. Note that like parts are designated by like reference numerals or characters throughout the description of the embodiments.

As illustrated in FIG. 1, an assembly ball 1 of the first embodiment includes a plurality of strips 100 having a circumferential length. The strips 100 are assembled convexly outward as viewed in the radial direction so as to substantially form a sphere as a whole. Each of the strips 100 overlaps other strips at a strip overlapping portion 14 where these strips intersect with one another, and the strip overlapping portions 14 of them are joined together by a strip joining member 15.

The strips 100 may be flat or may be curved in advance in a rounded shape in the longitudinal direction. In the former case, the strips 100 are assembled while being smoothly curved in the longitudinal direction so as to be convex outward as viewed in the radial direction. In the latter case, the rounded shape in the longitudinal direction is positioned such that the strips 100 are assembled to be convex outward as viewed in the radial direction. The strips 100 may be curved in advance in a rounded shape in the lateral direction in addition to or instead of the longitudinal direction. Pre-curving of the strips 100 in at least one of the longitudinal direction and the lateral direction facilitates the assembly and makes the assembled assembly ball 1 have a smoother outer surface, thus achieving better rebound property. In particular, it may be advantageous that the strips are curved in advance in the lateral direction as it is difficult to bend them in the lateral direction during the assembly. Further, each of the strips 100 may overlap the other strips 100 such that the strip overlapping portions 14 thereof are located either inside or outside as viewed in the radial direction, or inside and outside alternatively.

While FIG. 1 illustrates an example in which the assembly ball 1 is made of six strips (100), the number of strips is not limited to the example. The assembly ball 1 may be made of, for example, ten strips (100).

The strip 100 may be formed as one piece having the circumferential length of the assembly ball 1. Alternatively, short strips 10 obtained by dividing the strip 100 in the circumferential direction may be used by connecting them so as to have the circumferential length as a whole. In this case, as will be described later, each of the short strips 10 includes a first end portion 11, a second end portion 12, and an intermediate portion 13 between them. Among three of the short strips 10, the first end portion 11 of the first short strip 10, the second end portion 12 of the second short strip 10, and the center of the intermediate portion 13 of the third short strip 10 are overlapped as the strip overlapping portions 14, and the strip overlapping portions 14 are joined together by the strip joining member 15. In the following, a description will be given of the assembly ball 1 formed by using the short strips 10; the description also applies to the assembly ball 1 formed by using the strips 100 in which the short strips 10 are connected in the circumferential direction.

While FIG. 1 illustrates an example in which the strip 100 is divided into four short strips (10), the number of the short strips is not limited to the example. The strip 100 may be divided into, for example, six short strips (10).

The assembly ball 1 is formed by assembling the short strips 10, and will be described below by taking an example of five short strips 10*a*, 10*b*, 10*c*, 10*d*, and 10*e* (the details of the assembly will be described later). Although the short strips 10 have the same structure, they are denoted by different reference characters 10*a*, 10*b*, 10*c*, 10*d*, and 10*e* for the convenience of explanation. That is, the short strips 10 in the same relative positional relationship as them have the same structure. The short strips 10*a*, 10*b*, 10*c*, 10*d*, and 10*e* may be simply referred to as "short strip 10" when features common to all of them are described.

Each of the short strips 10 includes the first end portion 11, the second end portion 12 on the opposite side of the first end portion 11, and the intermediate portion 13 between them. The second end portion 12 of the short strip 10*e* overlaps the center of the intermediate portion 13 of the short strip 10*a*. The second end portion 12 of the short strip 10*a* overlaps the center of the intermediate portion 13 of the short strip 10*b*. The second end portion 12 of the short strip 10*b* overlaps the center of the intermediate portion 13 of the short strip 10*c*. The second end portion 12 of the short strip 10*c* overlaps the center of the intermediate portion 13 of the short strip 10*d*. The second end portion 12 of the short strip 10*d* overlaps the center of the intermediate portion 13 of the short strip 10*e*. Those portions serve as the strip overlapping portions 14. The short strips 10*a*, 10*b*, 10*c*, 10*d*, and 10*e* are assembled convexly outward as viewed in the radial direction so as to substantially form a sphere as a whole.

The short strips 10 may be flat or may be curved in advance in a rounded shape in the longitudinal direction as with the strips 100. In the former case, the short strips 10 are assembled while being smoothly curved in the longitudinal direction so as to be convex outward as viewed in the radial direction. In the latter case, the rounded shape in the longitudinal direction is positioned such that the short strips 10 are assembled to be convex outward as viewed in the radial direction. The short strips 10 may be curved in advance in a rounded shape in the lateral direction in addition to or instead of the longitudinal direction. Pre-curving of the short strips 10 in at least one of the longitudinal direction and the lateral direction facilitates the assembly and makes the assembled assembly ball 1 have a smoother outer surface, thus achieving better rebound property. In particular, it may be advantageous that the short strips are curved in advance in the lateral direction as it is difficult to bend them in the lateral direction during the assembly. Further, each of the short strips 10 may overlap the other short strips 10 such that the strip overlapping portions 14 thereof are located either inside or outside as viewed in the radial direction, or inside and outside alternatively.

When assembled in this manner, the short strips 10*a*, 10*b*, 10*c*, 10*d*, and 10*e* form a pentagonal space G1 in the center. Besides, a small space G2 is formed between an adjacent pair of the short strips 10 on the outside of the short strips 10*a*, 10*b*, 10*c*, 10*d*, and 10*e*.

The strip overlapping portions 14 are overlapped such that the intermediate portion 13 of each of the short strips 10 is located on the outer surface side of the assembly ball 1, while the first end portion 11 and the second end portion 12 are located on the inner surface side of the assembly ball 1.

The strip overlapping portions 14 are fixed at a point by the strip joining member 15 that penetrates the first end portion 11, the second end portion 12, and the center of the intermediate portion 13 of three short strips 10 which overlap one another. As will be described later, the strip joining member 15 can be implemented by providing a protrusion 16 in the intermediate portion 13 and a hole (strip hole) 17 in the first end portion 11 and the second end portion 12 of the short strip 10. The strip joining member 15 may also be implemented by adhesion of an adhesive, rivets or screws.

In the assembly ball 1 having the structure as described above, the intersection (the strip overlapping portions 14) where three short strips 10 overlap is fixed at a point, and the short strips 10 of the same shape are assembled convexly outward as viewed in the radial direction. This provides springiness and ensures appropriate rebound property.

Figure 2:
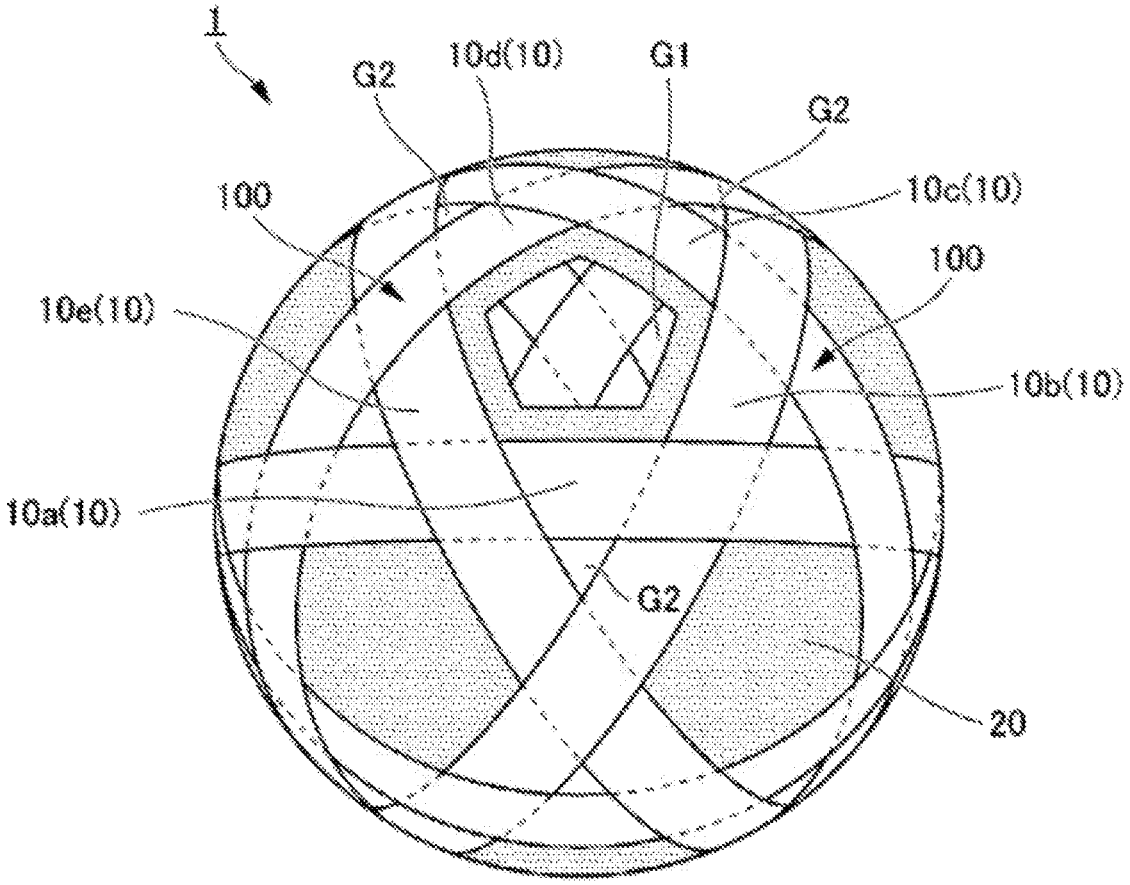
FIG. 2 is a front view of an assembly ball, which is made of strips and embedded plates, according to the first embodiment.
Figure 3:
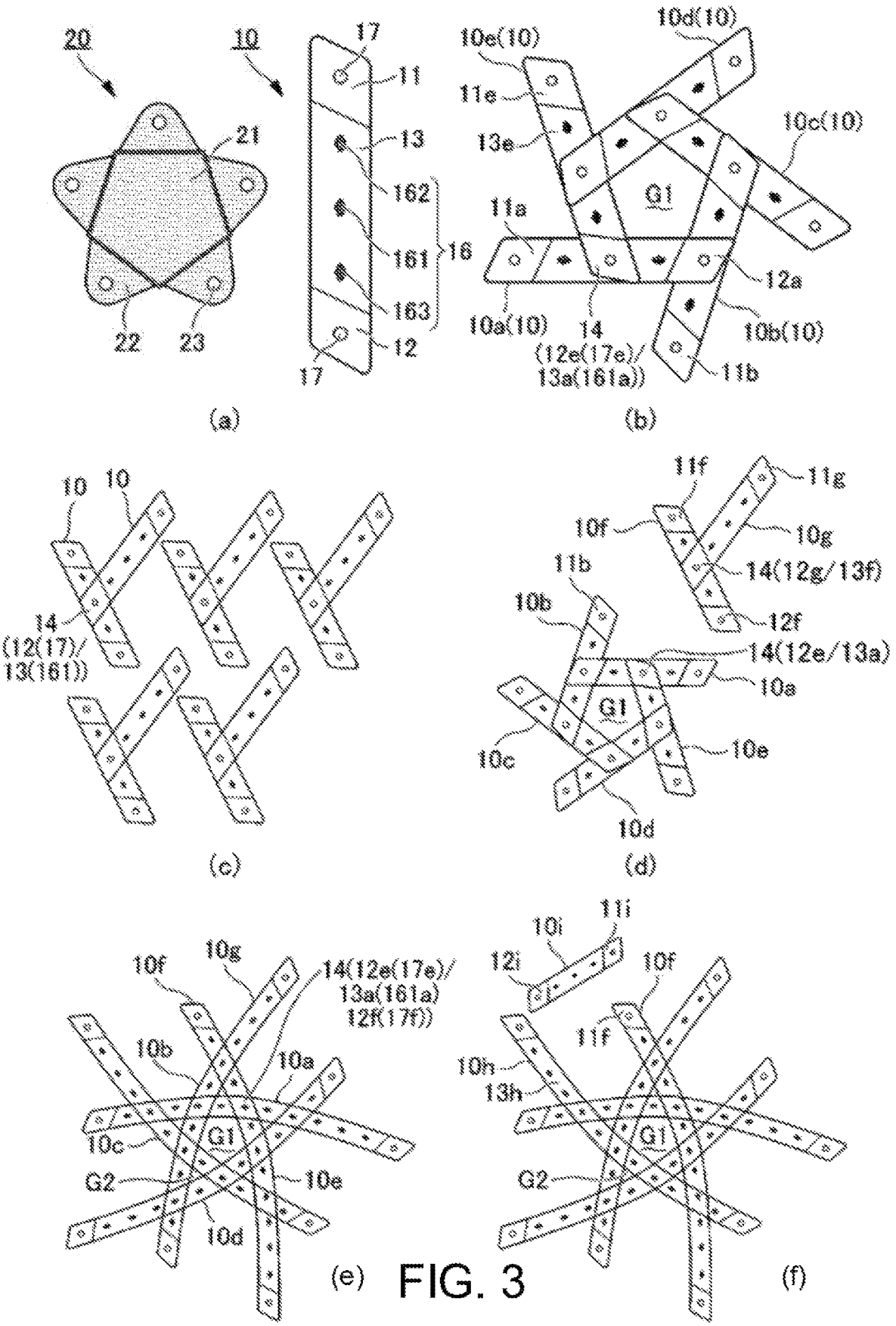
FIG. 3 is a diagram (1) illustrating the assembly process of the assembly ball according to the first embodiment.

The assembly ball 1 may also be configured as illustrated in FIG. 2. Specifically, the assembly ball 1 may further include an embedded plate 20 configured to be assembled to the short strips 10. In this case, the embedded plate 20 includes a lid portion 21 and attachment portions 22 projecting from the outer periphery of the lid portion 21 as illustrated in FIG. 3(*a*). The attachment portions 22 are each overlapped with an end side of the intermediate portion of a corresponding one of the short strips 10. The embedded plate 20 is joined to the short strips 10 by an embedded plate joining member 23 such that the lid portion 21 fills at least one space G1 formed by the short strips 10.

As the embedded plate joining member 23, the embedded plate 20 has embedded plate holes 23 each provided in one of the attachment portions 22.

The embedded plate 20 is arranged to fill the space G1 as at least one of the above-mentioned spaces G1 and G2. The assembly will be more specifically described later. The embedded plate 20 filling the space G1 formed by the short strips 10*a*, 10*b*, 10*c*, 10*d*, and 10*e* enables uniform springiness of the short strips 10*a*, 10*b*, 10*c*, 10*d*, and 10*e*, thus functioning as a stabilizer.

Incidentally, in FIG. 2, the embedded plate 20 in the upper center is cut out to show the space G1 for the sake of explanation.

Figure 4:
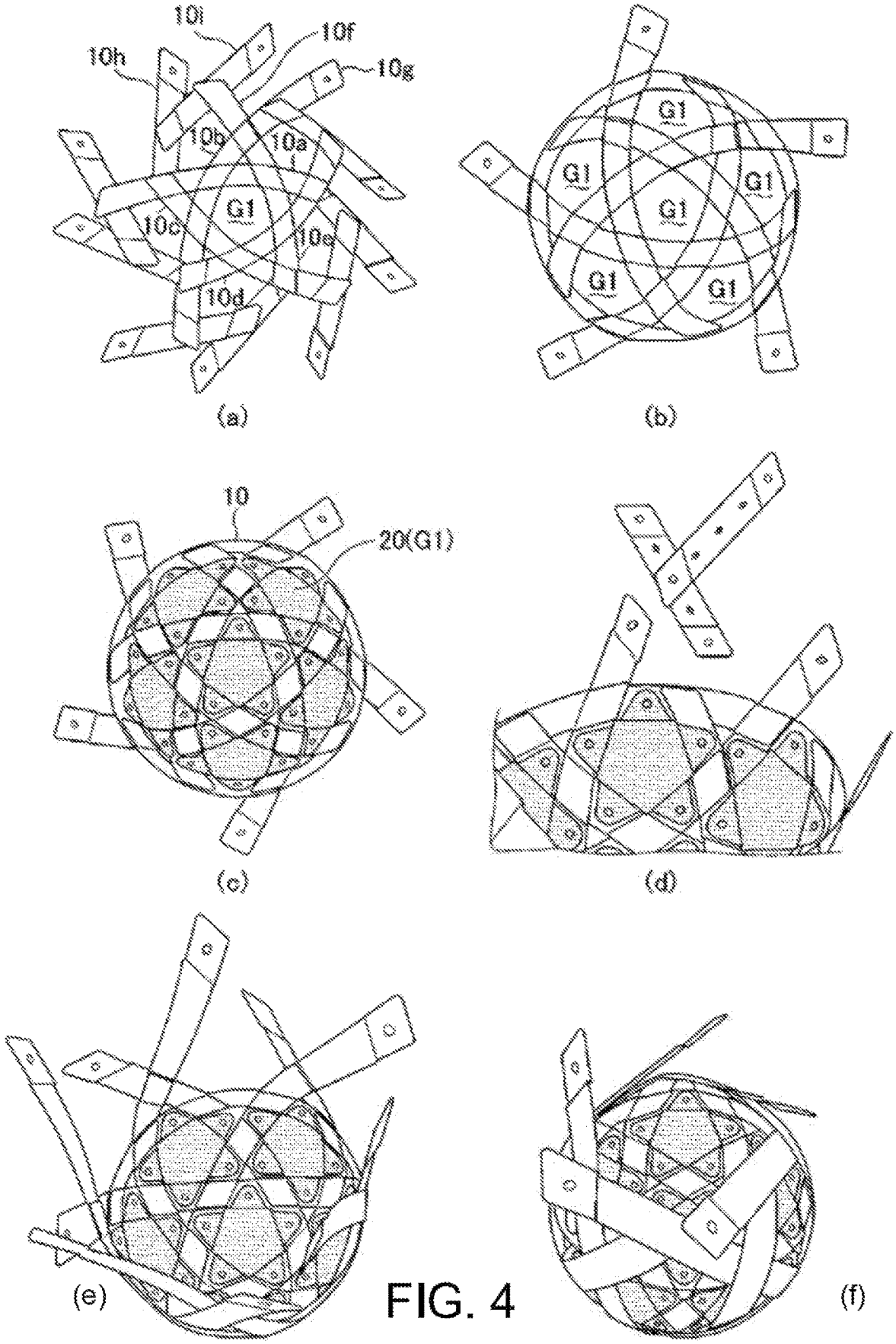
FIG. 4 is a diagram (2) illustrating the assembly process of the assembly ball according to the first embodiment.

Next, the assembly process of the assembly ball 1 will be described with reference to FIGS. 3 to 5.

First, the short strips 10 and the embedded plate 20 will be described further with reference to FIG. 3(*a*). Each of the short strips 10 includes the first end portion 11, the second end portion 12, and the intermediate portion 13 between them. The short strip 10 is provided with, as the strip joining member 15, the protrusion 16 protruding from the intermediate portion 13 toward the inner side of the sphere, and the strip hole 17 formed in the first end portion 11 and the second end portion 12, in which the protrusion 16 is to be fitted. In the example of FIG. 3(*a*), the protrusion 16 is arranged in three locations (a protrusion 161 in the center, a protrusion 162 on a first end side, and a protrusion 163 on a second end side), while the strip hole 17 is arranged at a position in both the first end portion 11 and the second end portion 12.

The embedded plate 20 includes the lid portion 21 and the attachment portions 22 projecting from the outer periphery of the lid portion 21. In this example, the lid portion 21 is formed in a pentagonal shape so as to fit the shape of the space G1, and five attachment portions 22 are arranged correspondingly to the sides of the pentagon. Each of the attachment portions 22 is provided with one embedded plate hole 23 in which the protrusion 16 of the short strip 10 is to be fitted.

The process of assembling the short strips 10 and the embedded plate 20 into the assembly ball 1 will be described below. In the case of forming the assembly ball with only the short strips 10, steps of attaching the embedded plate 20 are omitted.

First, as illustrated in FIG. 3(*b*), the five short strips 10*a*, 10*b*, 10*c*, 10*d*, and 10*e* are placed as described above. That is, the second end portion 12 (12*e*) of the short strip 10*e* is overlapped with the center of the intermediate portion 13 (13*a*) of the short strip 10*a*. The second end portion 12 (12*a*) of the short strip 10*a* is overlapped with the center of the intermediate portion 13 of the short strip 10*b*. The second end portion 12 of the short strip 10*b* is overlapped with the center of the intermediate portion 13 of the short strip 10*c*. The second end portion 12 of the short strip 10*c* is overlapped with the center of the intermediate portion 13 of the short strip 10*d*. The second end portion 12 of the short strip 10*d* is overlapped with the center of the intermediate portion 13 (13*e*) of the short strip 10*e*. Those portions are overlapped as the strip overlapping portions 14 to form the base of the assembly ball 1. At this time, for example, in the two strip overlapping portions 14 of the short strip 10*a* and the short strip 10*e*, the protrusion 161 (161*a*) in the center of the intermediate portion 13 (13*a*) of the short strip 10*a* overlaps the strip hole 17 (17*e*) in the second end portion 12 (12*e*) of the short strip 10*e*.

Next, as illustrated in FIG. 3(*c*), the protrusion 161 in the center of the intermediate portion 13 of one short strip 10 and the strip hole 17 in the second end portion 12 of another short strip 10 are overlapped with each other to prepare five sets of two short strips 10 combined together. As illustrated in FIG. 3(*d*), each set, for example, a set of short strips 10*f* and 10*g* is assembled to the base illustrated in FIG. 3(*b*).

Specifically, the second end portion 12 (12*f*) of the short strip 10*f* is overlapped with the strip overlapping portions 14 in the center of the intermediate portion 13 (13*a*) of the short strip 10*a* and the second end portion 12 (12*e*) of the short strip 10*e*. The first end portion 11 (11*b*) of the short strip 10*b* is overlapped with the strip overlapping portions 14 in the center of the intermediate portion 13 (13*f*) of the short strip 10*f* and the second end portion 12 (12*g*) of the short strip 10*g*. As a result, as illustrated in FIG. 3(*e*), the strip hole 17*f* in the second end portion 12 (12*f*) of the short strip 10*f* is newly overlapped with the strip overlapping portions 14 of the two short strips 10*a* and 10*e*, and thereby the three short strips 10 are assembled.

Then, as illustrated in FIG. 3(*f*), one short strip 10, for example, a short strip 10*i* is assembled to the base. Specifically, as illustrated in FIG. 3(*f*), adjacent short strips 10*f* and 10*h* are assembled by coupling the first end portion 11 (11*f*) of the short strip 10*f* and the center of the intermediate portion 13 (13*h*) of the short strip 10*h* with the first end portion 11 (11*i*) and the second end portion 12 (12*i*) of the short strip 10*i*, respectively. In this manner, each adjacent pair of the short strips 10 is connected to each other as illustrated in FIG. 4(*a*). By repeating the steps, the process reaches the stage as illustrated in FIG. 4(*b*) where the lower half of the assembly ball 1 is almost formed. At this stage, the embedded plate 20 is attached as illustrated in FIG. 4(*c*). After that, as illustrated in FIGS. 4(*d*) to 4(*f*), sets of two short strips 10 combined together are sequentially assembled to form the upper half of the assembly ball 1. Incidentally, the protrusion 16 is not illustrated in FIGS. 4(*a*) to 4(*f*) (and FIGS. 5(*a*) to 5(*e*)).

Figure 5:
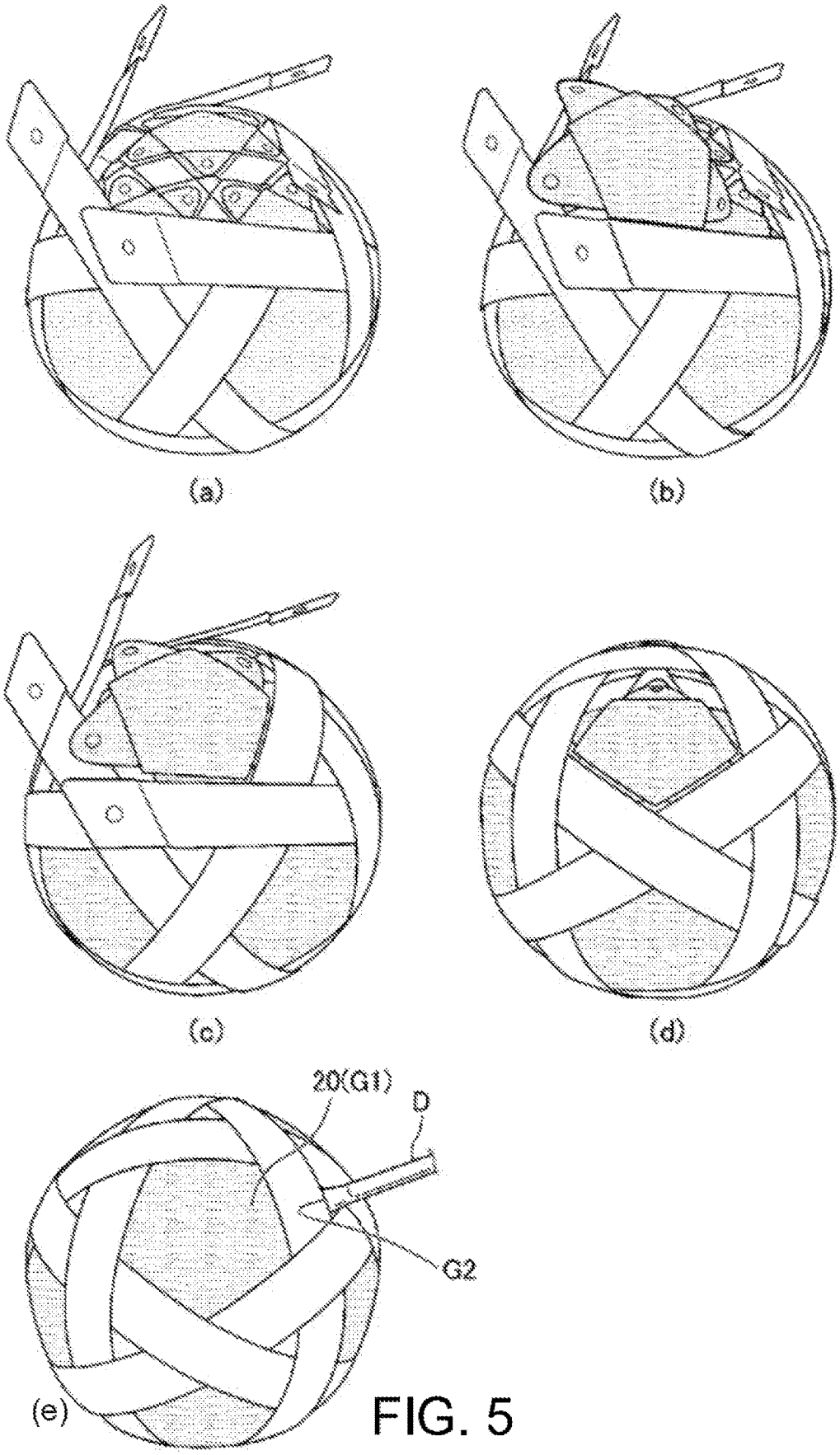
FIG. 5 is a diagram (3) illustrating the assembly process of the assembly ball according to the first embodiment.

As illustrated in FIGS. 5(*a*) and 5(*b*), the embedded plates 20 are sequentially attached as the upper half is formed. FIGS. 5(*c*) to 5(*e*) illustrate how the last embedded plate 20 is attached. The last embedded plate 20 is assembled to the short strips 10 to the extent possible before the assembly ball 1 is closed. In the last step, a tool D is inserted through the adjacent space G2 to fit the protrusion 16 of the short strip 10 into the embedded plate hole 23 in a corresponding one of the attachment portions 22 of the embedded plate 20.

In the above step, the embedded plate hole 23 in the attachment portion 22 of the embedded plate 20 is fitted with the protrusion 162 on the first end side or the protrusion 163 on the second end side among the protrusions 16 of the short strip 10. In other words, each midpoint of the strip joining members 15 in the adjacent strip overlapping portions 14 is fixed, which, as described above, enables uniform springiness of the assembly ball 1 and achieves the function of a stabilizer.

As a modification, the short strip 10 may be provided with a groove between the intermediate portion 13 and the first end portion 11 as well as the second end portion 12. With this groove, the first end portion 11 and the second end portion 12 can be moved flexibly with respect to the intermediate portion 13, which facilitates the assembly and also makes it possible to adjust the rebound property of the assembled assembly ball 1.

Figure 6:
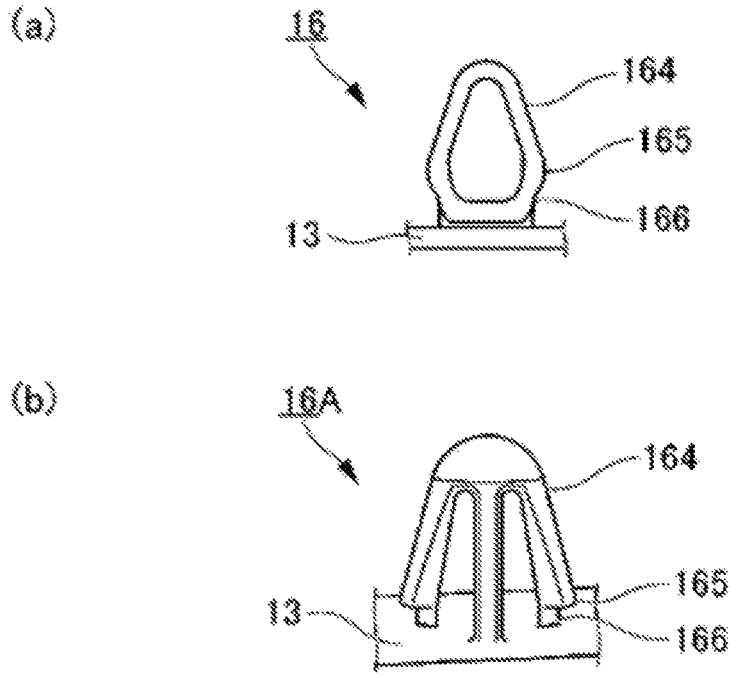
FIG. 6 is a diagram for explaining a protrusion provided on a strip (short strip) according to the first embodiment.

The protrusion 16 of the short strip 10 will be described with reference to FIG. 6. As described above, the strip joining member 15 may be implemented by adhesives, rivets, screws or the like; however, for easy assembly by hand, it is preferable to use the strip hole 17 or the embedded plate hole 23 and the protrusion 16 to be fitted therein. FIG. 6(*a*) illustrates an example of the protrusion 16, which includes a flared portion 164 extending in a bifurcated manner toward the base, a prominent portion 165, and a narrow portion 166. The flared portion 164 is formed to be flexible. Thereby, when the protrusion 16 is inserted into the strip hole 17 or the embedded plate hole 23, the prominent portion 165 passes through the strip hole 17 or the embedded plate hole 23, and the protrusion 16 is engaged therewith at the narrow portion 166.

FIG. 6(*b*) illustrates a protrusion 16A as another example of the protrusion 16. The protrusion 16A includes the flared portion 164 extending in a trifurcated manner toward the base, the prominent portion 165, and the narrow portion 166. When it is desired to make the protrusion fitted in the strip hole 17 or the embedded plate hole 23 not come off easily, the protrusion 16A is preferred as compared to the protrusion 16.

Figure 7:
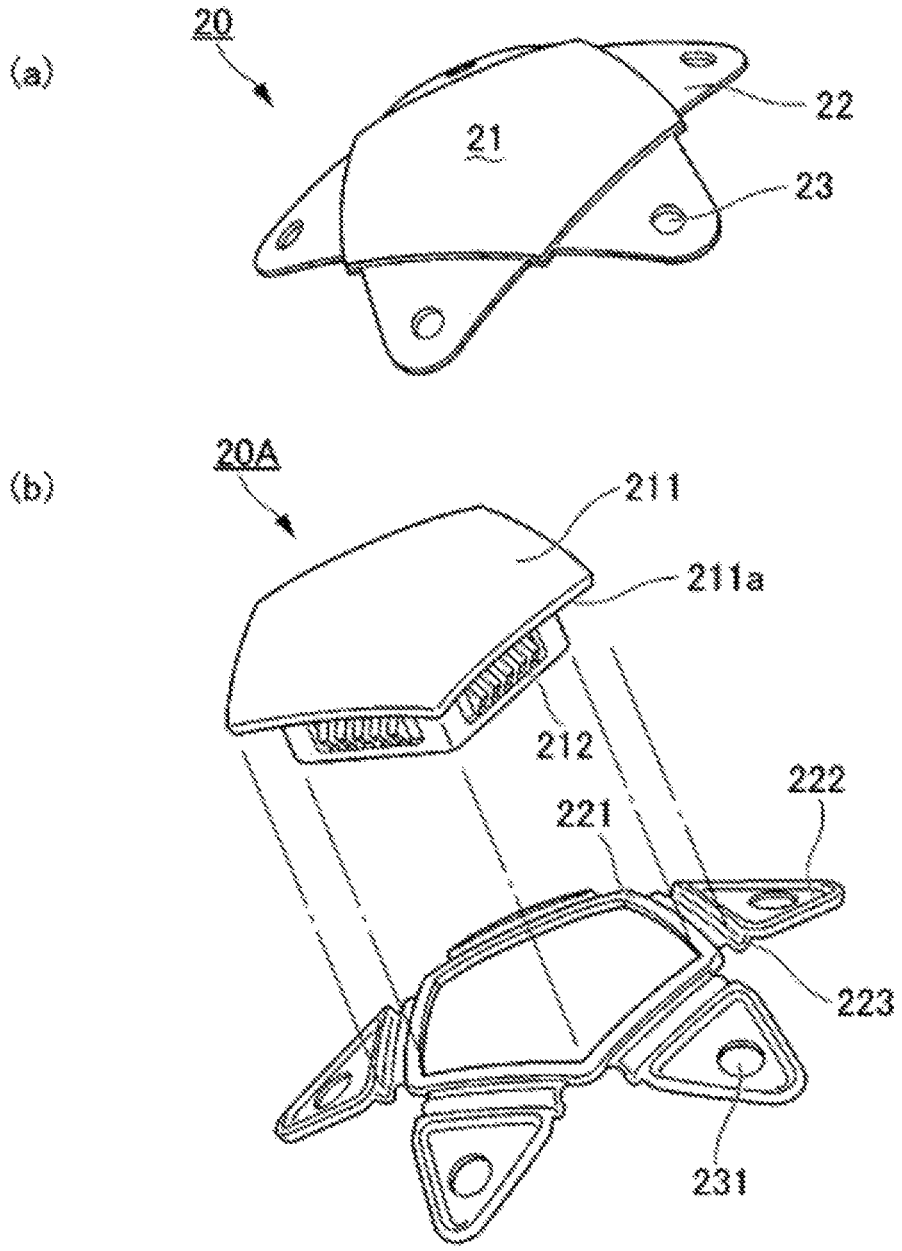
FIG. 7 is a diagram for explaining an embedded plate according to the first embodiment.

The embedded plate 20 will be described with reference to FIG. 7. FIG. 7(*a*) illustrates the embedded plate 20, in which the lid portion 21 and the attachment portions 22 are integrally formed.

FIG. 7(*b*) illustrates an embedded plate 20A as another example of the embedded plate 20. The embedded plate 20A includes a lid portion 211 and attachment portions 222, which are formed separately. Specifically, the attachment portions 222 each having an embedded plate hole 231 are arranged around an annular portion 221 separated from the lid portion 211. Further, a groove 223 is formed between the annular portion 221 and each of the attachment portions 222. In this structure, the annular portion 221 and the attachment portions 222 are flexible, which makes it easy to attach the embedded plate to inside the assembly ball 1 during the assembly. The lid portion 211 is fitted in the annular portion 221 after the outer shell of the assembly ball 1 is formed. The lid portion 211 includes a retractable engagement portion 212 in its base. The engagement portion 212 is retracted in the base while being inserted into the annular portion 221 and projects when fitted therein to engage with the annular portion 221. Once the lid portion 211 is fitted in the annular portion 221, a peripheral edge 211*a* of the lid portion 211 covers the groove 223 and is located in a position substantially in contact with the short strips 10 in the assembly ball 1 (see FIG. 2).

Next, the assembly ball 1 according to the second embodiment will be described. The assembly ball 1 of the second embodiment has basically the same structure as that of the first embodiment except that an embedded plate 30A is used in place of the embedded plate 20 (20A). Therefore, the embedded plate 30A will be described below.

In the assembly ball 1 of the first embodiment, the peripheral edge 211*a* of the lid portion 211 of the embedded plate 20A is located in a position which is substantially in contact with the short strips 10 at the same level. However, since the ball is an assembled one, the boundaries are not completely connected. Therefore, if the user uses the ball for a strenuous activity, such as kicking it barefoot or hitting it hard with their bare hand, it may occur that the exposed skin of their foot or hand is caught in the gap between the peripheral edge 211*a* and the short strips 10, resulting in an injury accompanied by pain or bleeding. In order to avoid the possibility of such pain or injury, the assembly ball 1 of the second embodiment is configured as described below.

Figure 8:
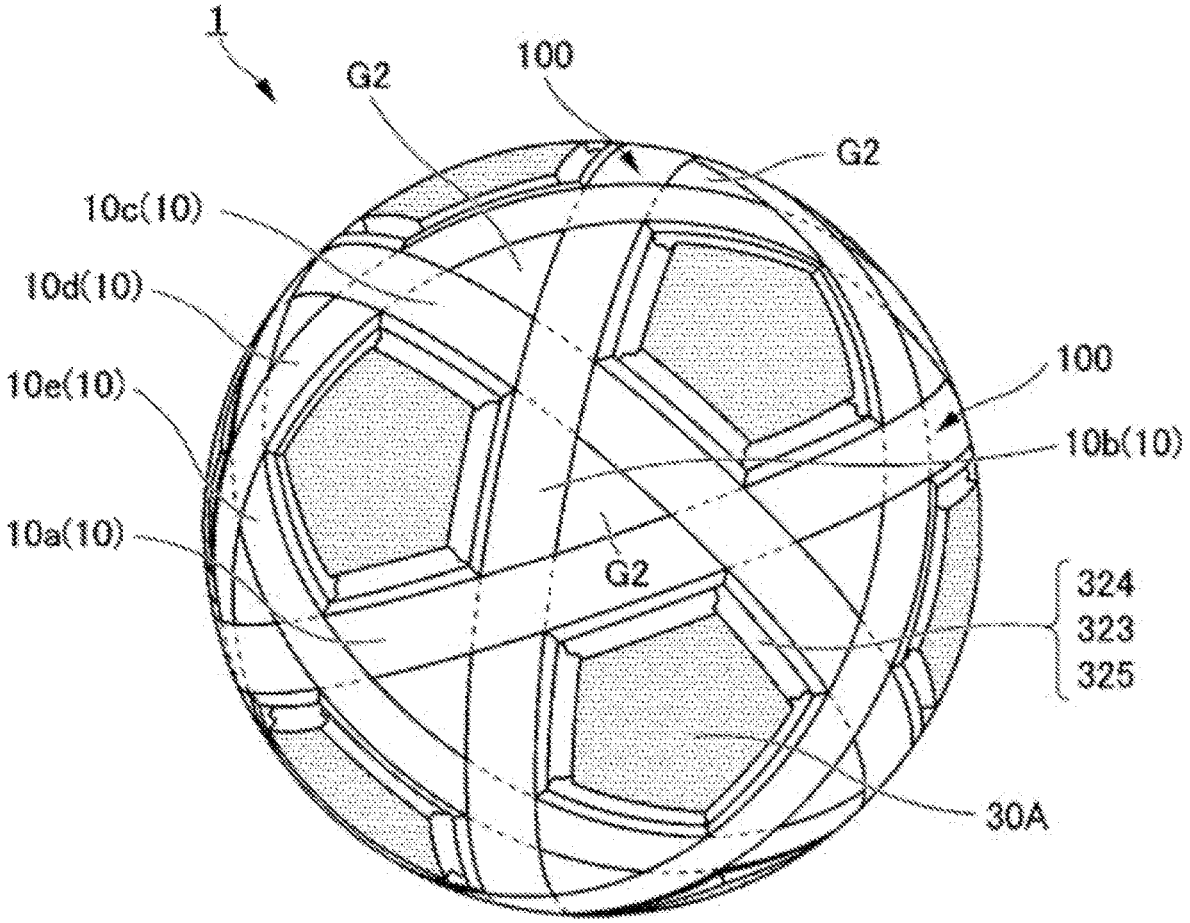
FIG. 8 is a front view of an assembly ball, which is made of strips and embedded plates, according to the second embodiment.
Figure 9:
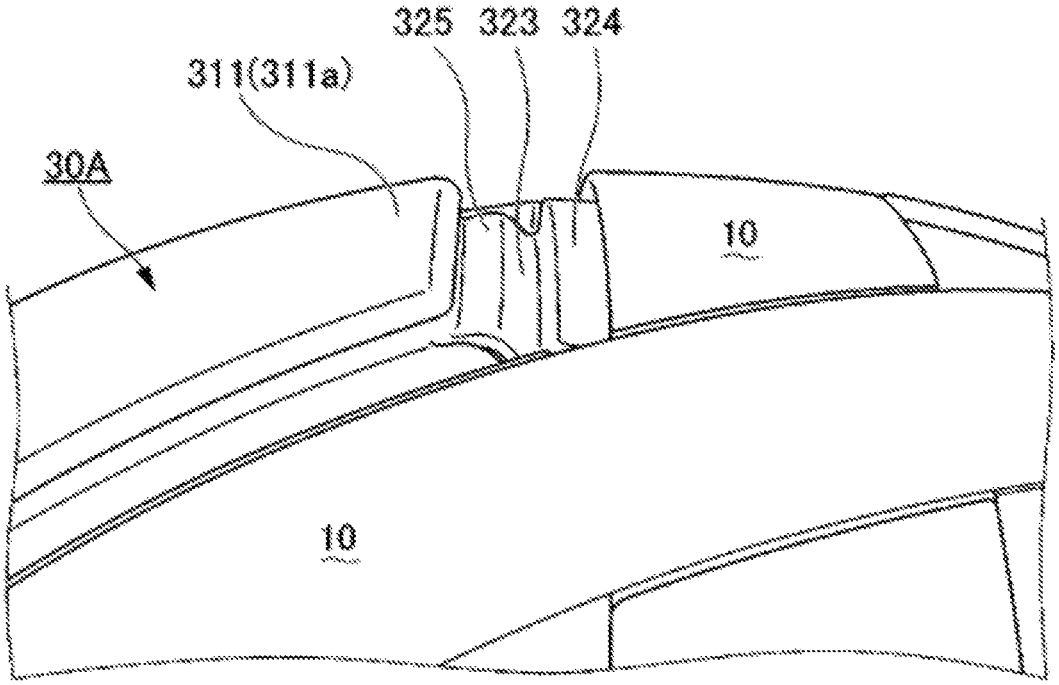
FIG. 9 is an enlarged external view for explaining the relationship between an embedded plate and a strip (short strip) illustrated in FIG. 8.

In the assembly ball 1 of the second embodiment, as illustrated in FIGS. 8 and 9, the embedded plate 30A is joined to the short strips 10 such that a significant separation portion (324, 323, 325) is provided between a peripheral edge 311*a* of a lid portion 311 of the embedded plate 30A and the short strips 10. As will be described later, the separation portion (324, 323, 325) is formed from a part of attachment portions 322 of the embedded plate 30A, and are exposed without being covered by the peripheral edge 311*a* of the lid portion 311.

Figure 10:
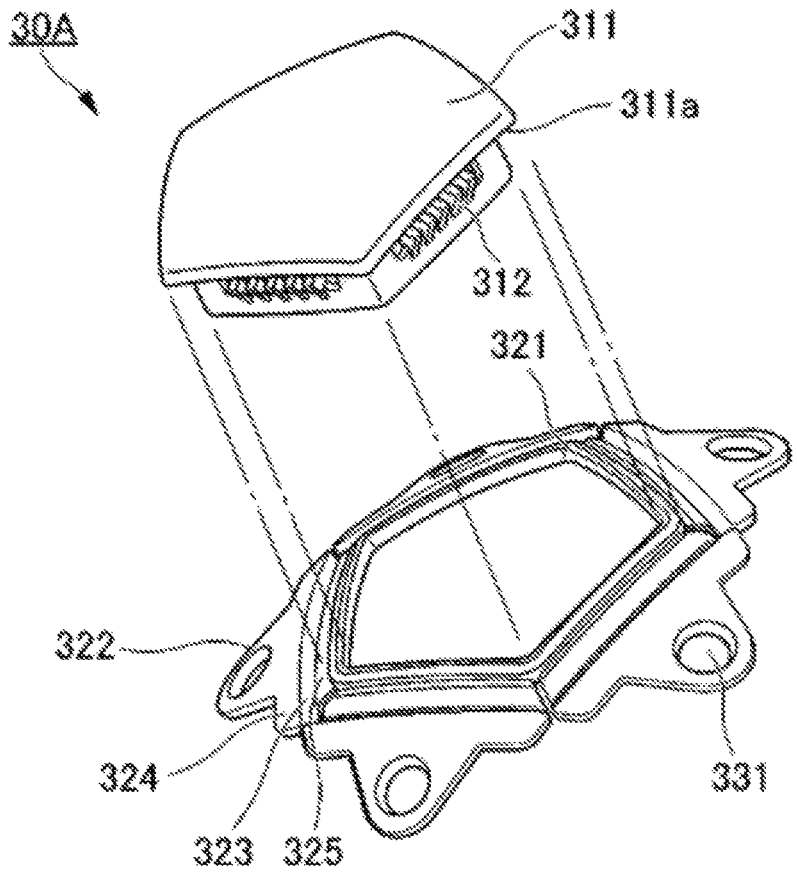
FIG. 10 illustrates an embedded plate, in which a lid portion and an attachment portion are formed separately, according to the second embodiment.
Figure 11:
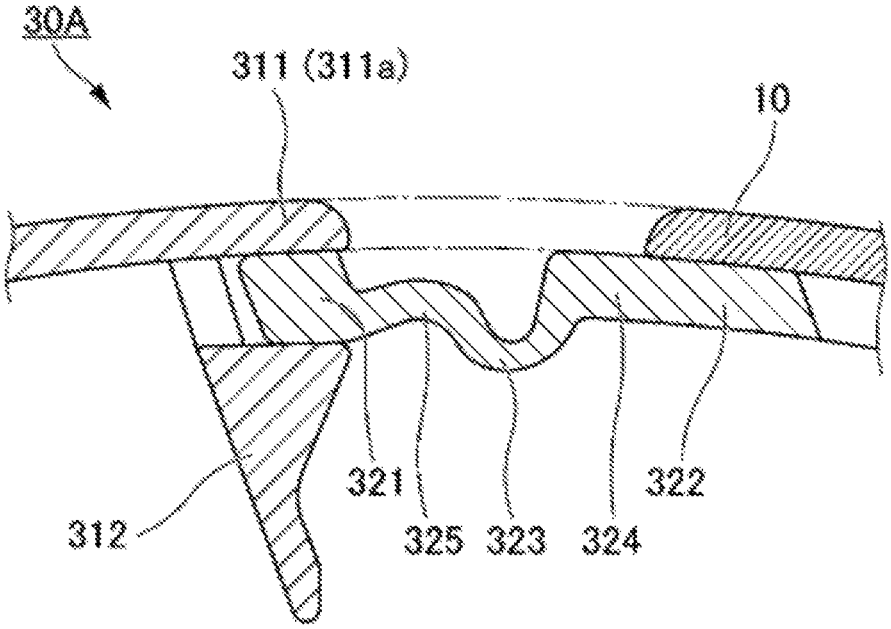
FIG. 11 is a cross-sectional view for explaining the relationship between an embedded plate and a strip (short strip) illustrated in FIG. 9.

As illustrated in FIG. 10, in the embedded plate 30A, the lid portion 311 is formed separately from the attachment portions 322. The above-mentioned separation portion (324, 323, 325) includes a wide root portion 324 of the attachment portions 322, a connection portion 325 that is connected to an annular portion 321, and a groove 323 between the wide root portion 324 and the connection portion 325. FIG. 11 illustrates a cross-sectional view of these portions. As can be seen in FIG. 11, the annular portion 321 is surrounded by the attachment portions 322 and fitted between the peripheral edge 311*a* of the lid portion 311 and an engagement portion 312 configured to be retractable into the base. Then, on the outside of the connection portion 325 extending outward from the annular portion 321, the groove 323 recessed from the connection portion 325, and the wide root portion 324 rising from the groove 323, the attachment portions 322 are joined to the protrusions 16 (16A) of the short strips 10 using embedded plate holes 331 (see FIG. 10). In this structure, the lid portion 311 and the short strips 10 are set at substantially the same level. On the other hand, the groove 323, the connection portion 325 and the wide root portion 324 of the attachment portions 322 are located lower than the lid portion 311 and the short strips 10 by at least the thickness thereof.

In this manner, the separation portion (324, 323, 325), which is set lower than the lid portion 311 and the short strips 10, is provided between the peripheral edge 311*a* of the lid portion 311 of the embedded plate 30A and the short strips 10. With this, even if the assembly ball 1 is deformed when kicked barefoot or hit with a bare hand, it does not occur that the skin or the like is caught between the peripheral edge 311*a* of the lid portion 311 and the short strips 10. Thus, the assembly ball 1 that is comfortable to kick can be provided.

In the second embodiment, a description has been given of the embedded plate 30A in which the lid portion 311 is separated from the attachment portions 322 similarly to the embedded plate 20A of the first embodiment; however, an embedded plate in which the lid portion 311 and the attachment portions 322 are integrally formed as with the embedded plate 20 may also be provided with the separation portion (324, 323, 325). Further, the separation portion (324, 323, 325) has been described as being located lower than the lid portion 311 and the short strips 10 by at least the thickness thereof, i.e., being concave as a whole as viewed from the lid portion 311 and the short strips 10; however, the separation portion (324, 323, 325) may be in a convex shape that protrudes as a whole as viewed from the lid portion 311 and the short strips 10, since it need only be able to significantly separate the lid portion 311 from the short strips 10 at a level different from that of the lid portion 311 and the short strips 10. Furthermore, although the separation portion has been described as including the concave groove 323, it may include a convex portion in place of or in addition to the concave groove 323.

Below is a suitable example of the dimensions of the separation portion (324, 323, 325). However, the dimensions vary depending on the design, size and the like of the assembly ball 1, and therefore are not limited to the following example. Through a test in which the assembly ball formed using the embedded plate 30A was kicked hard barefoot, it was found that the skin or the like could be caught when the length of the separation portion (324, 323, 325), i.e., the distance between the peripheral edge 311*a* of the lid portion 311 of the embedded plate 30A and the short strips 10 is in the range of 0 (the value is not exactly zero since the ball is an assembled one) to 6 mm. Although such an incident in which the skin was caught did not occur when the length of the separation portion (324, 323, 325) was 7 mm or more, the length is preferably set to 8 mm or more in consideration of the assembly variation of each member.

As to the level of the separation portion (324, 323, 325) in the assembly ball 1 used for the test, the separation portion (324, 323, 325) was set lower than the upper surfaces of the lid portion 311 of the embedded plate 30A and the short strips 10 by the thickness thereof (about 1 mm).

(Modification)

In the first and second embodiments described above, the strip overlapping portions 14 of the short strips 10 (or the strips 100) are fixed by the strip joining member 15 to form the assembly ball 1. Besides, when uniform springiness of the short strips 10 (or the strips 100) is required to obtain a function like a stabilizer, the embedded plates 20 are further attached thereto. Instead of fixing the strip overlapping portions 14 of the short strips 10 (or the strips 100) by the strip joining member 15, the assembly ball 1 may be formed by fixing the embedded plate 20 to the short strips 10 (or the strips 100) with the embedded plate joining member (see FIG. 2). With this, it is possible to obtain the assembly ball 1 provided with the embedded plate 20 that enables uniform springiness of the short strips 10 (or the strips 100), thus functioning as a stabilizer, by a simpler procedure.

Specifically, the assembly ball 1 of the modification includes a plurality of the strips 100 having a circumferential length and the embedded plate 20 assembled to the strips 100. The strips 100 are assembled convexly outward as viewed in the radial direction so as to substantially form a sphere as a whole. Each of the strips 100 overlaps other strips at the strip overlapping portion where these strips intersect with one another. The embedded plate 20 includes the lid portion 21 and the attachment portions 22 projecting from the outer periphery of the lid portion 21. The attachment portions 22 are overlapped with the strips 100, and the embedded plate 20 is joined to the strips 100 by the embedded plate joining member 23 such that the lid portion 21 fills at least one space G1 formed by the strips 100.

As in the first and second embodiments described above, the strip 100 may be formed as one piece having the circumferential length of the assembly ball 1. Alternatively, the short strips 10 obtained by dividing the strip 100 in the circumferential direction may be used by connecting them so as to have the circumferential length as a whole. In this case, each of the short strips 10 includes the first end portion 11, the second end portion 12, and the intermediate portion 13 between them. Among three of the short strips 10, the first end portion 11 of the first short strip 10, the second end portion 12 of the second short strip 10, and the center of the intermediate portion 13 of the third short strip 10 are overlapped as the strip overlapping portions 14, and the attachment portions 22 of the embedded plate 20 are each overlapped with an end side of the intermediate portion 13 of the short strip 10.

In order to fix the embedded plate 20 to the short strips 10, as in the first and second embodiments, each of the short strips 10 may include the protrusion 16 protruding from the intermediate portion 13 toward the inner side of the sphere, and the embedded plate 20 may be provided with the embedded plate hole 23 in the attachment portions 22 as the embedded plate joining member 23.

Although specific embodiments of the disclosure have been described and illustrated, it is to be understood that the disclosure is not to be limited to the embodiments disclosed herein. As would be apparent to those skilled in the art, various changes, modifications, and alterations may be made within the scope of the disclosure as defined in the appended claims.

The invention claimed is:

1. An assembly ball comprising:

a plurality of strips having a circumferential length; and an embedded plate that is assembled to the strips, wherein the strips are assembled convexly outward as viewed in a radial direction so as to substantially form a sphere as a whole, the strips each overlap other strips at their respective strip overlapping portions where the strips intersect with one another, the embedded plate includes a lid portion and an attachment portion projecting from the outer periphery of the lid portion, the attachment portion is overlapped with the strips, and the embedded plate is joined to the strips by an embedded plate joining member such that the lid portion fills at least one space formed by the strips.

2. The assembly ball according to claim 1, wherein each of the strips is divided in a circumferential direction into short strips, each of the short strips includes a first end portion, a second end portion, and an intermediate portion between the first end portion and the second end portion, among three short strips, the first end portion of a first short strip, the second end portion of a second short strip, and the center of the intermediate portion of a third short strip are overlapped as the strip overlapping portions, and the attachment portion of the embedded plate is overlapped with an end side of the intermediate portion of a corresponding one of the short strips.

3. The assembly ball according to claim 2, wherein each of the short strips includes a protrusion that protrudes from the intermediate portion toward the inner side of the sphere, and the embedded plate includes an embedded plate hole in the attachment portion as the embedded plate joining member.

4. The assembly ball according to claim 1, wherein the embedded plate is joined to the strips such that a separation portion is provided between the peripheral edge of the lid portion of the embedded plate and the strips.

5. The assembly ball according to claim 2, wherein the embedded plate is joined to the strips such that a separation portion is provided between the peripheral edge of the lid portion of the embedded plate and the strips.

6. The assembly ball according to claim 3, wherein the embedded plate is joined to the strips such that a separation portion is provided between the peripheral edge of the lid portion of the embedded plate and the strips.

* * * * *